United States Patent [19]

Favaretto

[11] Patent Number: 4,662,681

[45] Date of Patent: May 5, 1987

[54] ADJUSTABLE CHAIR

[76] Inventor: Paolo Favaretto, Via Lovarini N.31, 35100 Padova, Italy

[21] Appl. No.: 626,353

[22] Filed: Jun. 29, 1984

[30] Foreign Application Priority Data

Sep. 7, 1983 [CA] Canada ..... 436149

[51] Int. Cl.[4] ..... A47C 1/02

[52] U.S. Cl. ..... 297/349; 297/353

[58] Field of Search ..... 297/353, 345, 328, 300, 297/355, 354, 411, 349, 422; 16/45–48

[56] References Cited

U.S. PATENT DOCUMENTS

| | | | |
|---|---|---|---|
| 2,698,629 | 1/1955 | Hall | 16/47 X |
| 3,526,430 | 9/1970 | Eldon, III | 297/353 |
| 3,610,687 | 10/1971 | Barker . | |
| 3,817,575 | 6/1974 | Bocksch et al. | 297/355 |
| 3,837,705 | 9/1974 | Marraccini | 297/353 |
| 3,880,465 | 4/1975 | Scheben | 297/355 X |
| 4,169,625 | 10/1979 | Petersen | 297/349 |
| 4,451,084 | 5/1984 | Seeley | 297/353 |
| 4,466,665 | 8/1984 | Aronowitz et al. | 297/353 |

FOREIGN PATENT DOCUMENTS

| | | | |
|---|---|---|---|
| 2202107 | 8/1973 | Fed. Rep. of Germany . | |
| 2065536 | 8/1974 | Fed. Rep. of Germany | 297/328 |
| 2706736 | 8/1978 | Fed. Rep. of Germany . | |
| 2119238 | 11/1983 | United Kingdom | 16/47 |

*Primary Examiner*—Peter A. Aschenbrenner
*Attorney, Agent, or Firm*—Sughrue, Mion, Zinn, Macpeak, and Seas

[57] ABSTRACT

A plastic adjustable chair having a base section which has a central base column and integral legs radiating therefrom, all of molded plastic, and a seat section having a seat shell of molded plastic tiltably mounted on a plastic seat column. The seat column is pivotally mounted on the base column by a gas cylinder. A plastic backrest column is pivotally mounted on the seat shell and is adjustable with a gas cylinder. A plastic backrest shell can slide vertically on the backrest column, controlled by a flexible plastic locking lever. Upholstered plastic back and seat cushions can be snapped onto the back and seat shells or removed for reupholstery or cleaning. Plastic arms bolt onto the underside of the seat shell for easy removal, and plastic castors can be snapped into or removed from the legs.

9 Claims, 24 Drawing Figures

ADJUSTABLE CHAIR

This invention relates to a chair made primarily of a plastic material, which has an attractive appearance, and which can be assembled or disassembled with a minimum of simple tools. In a preferred embodiment the chair can be adjusted in a number of ways to conform to its user's preferences.

Adjustable chairs used in offices and the like are usually made of metal and are difficult to assemble or disassemble. In addition a number of tools are usually needed for assembly or disassembly. It is therefore usually difficult to replace components of the chair which are damaged in use. In addition, the operating mechanisms of such chairs are normally visible in the form of a large box below the seat of the chair and present an unsightly appearance.

It is therefore an object of the present invention to provide a chair, made primarily of a plastic material, which can comparatively easily be assembled or disassembled using relatively few and simple tools. Components of the chair which are particularly subject to damage, such as the back, the upholstery components, the arms and the castors (where present) can be removed with few or no tools. Because the basic material of the chair is plastic which is molded in a given color rather than being coated with a color, scratches in the chair are less unsightly than in a conventional chair.

In its broadest aspect the present invention provides: a chair formed primarily of plastic material and comprising:

(a) a base, comprising a vertical central base column and legs radiating outwardly therefrom, said base column and legs all being integrally formed of plastic, (b) a seat section comprising a plastic seat shell, having upper and lower surfaces, a plastic central seat column extending downwardly below said seat shell, and a plurality of reinforcing plastic ribs integrally formed on the lower surface of said seat shell, (c) means connecting said seat shell to said seat column, (d) means connecting said seat column to said base column for rotation of said seat section about a vertical axis relative to said base, (e) a backrest column formed of plastic, (f) means connecting said backrest column to said seat shell, (g) a backrest shell of plastic removably connected to said backrest column and having a front surface, (h) upholstered back cushion means, and means for removably connecting said back cushion means to said first surface of said backrest shell, and (i) upholstered seat cushion means, and means for removably connecting said seat cushion means to said upper surface of seat shell.

Further objects and advantages of the invention will appear from the following description, taken together with the accompanying drawings in which.

Figure 1:
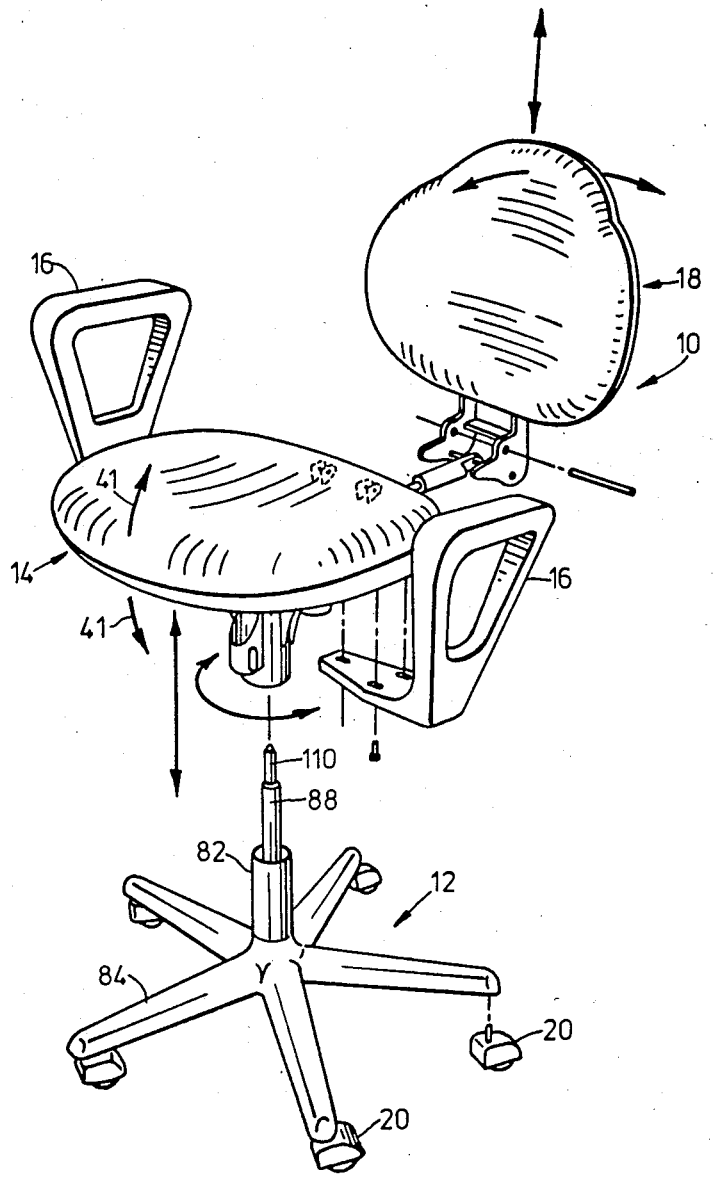
FIG. 1 is an exploded perspective view of a chair according to the invention.

Reference is first made to FIG. 1, which shows a chair 10 according to the invention. The chair 10 includes a base section generally indicated at 12, a seat section generally indicated at 14, arms 16, and a backrest section 18. The base section 12 is typically fitted with castors 20. The base section 12, castors 20, most of the seat section 14, arms 16 and most of the backrest section 18 are all largely formed from molded plastic, as will appear from the following drawings and description.

Figure 2:
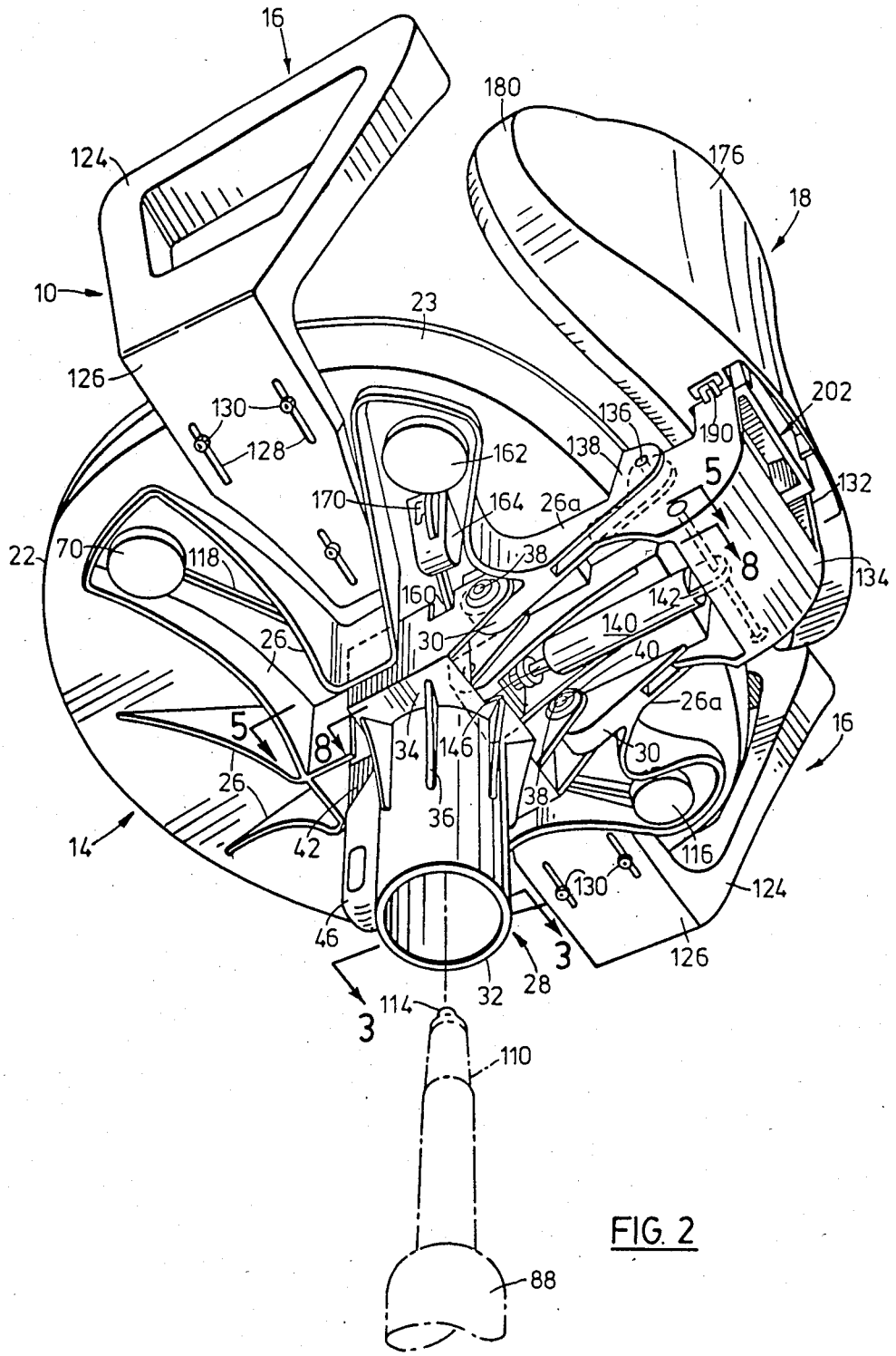
FIG. 2 is a perspective view from below of the seat and backrest portions of the chair of FIG. 1.
Figure 11:
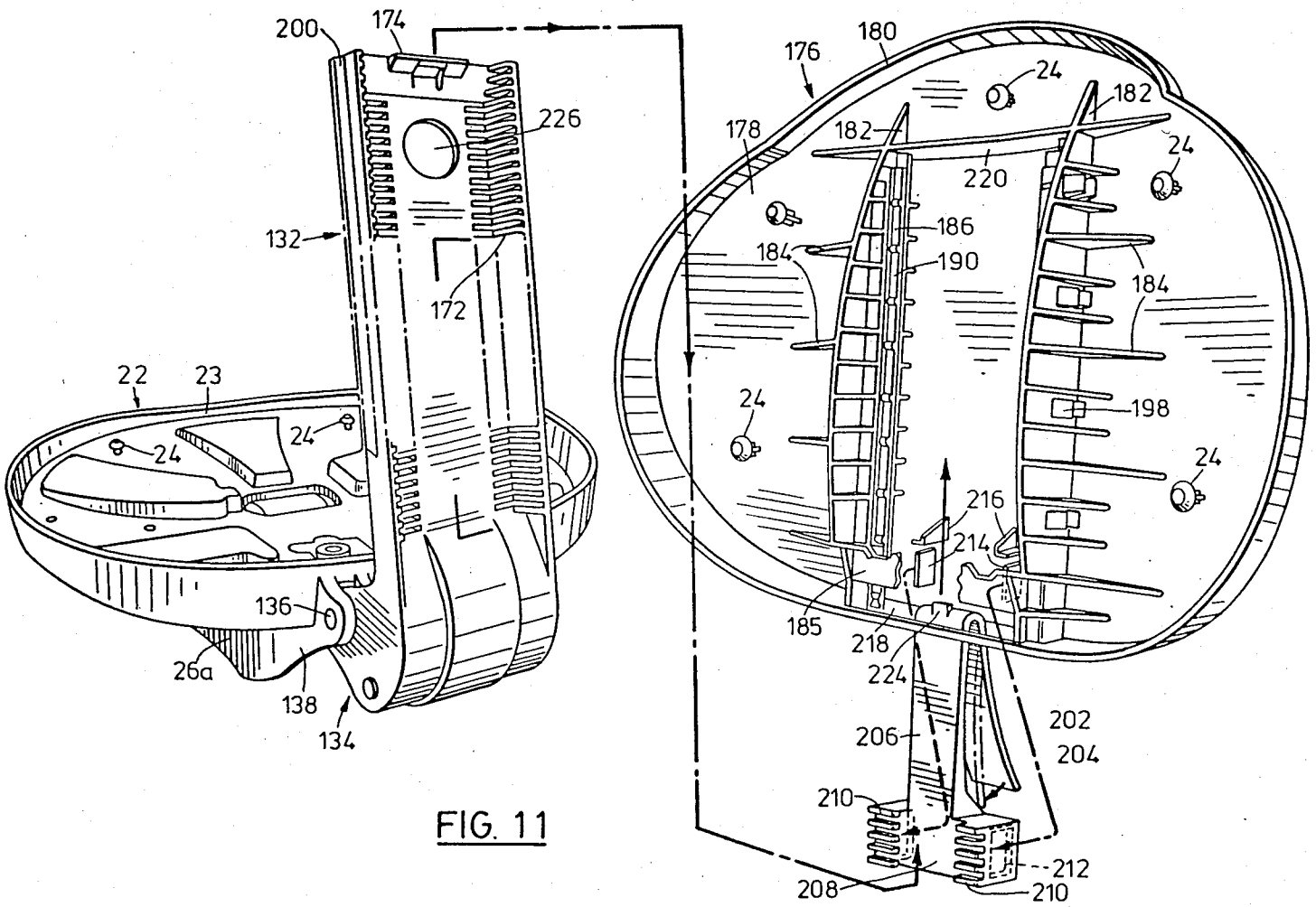
FIG. 11 is a perspective exploded view of the seat and backrest of the FIG. 1 chair.
Figure 12:
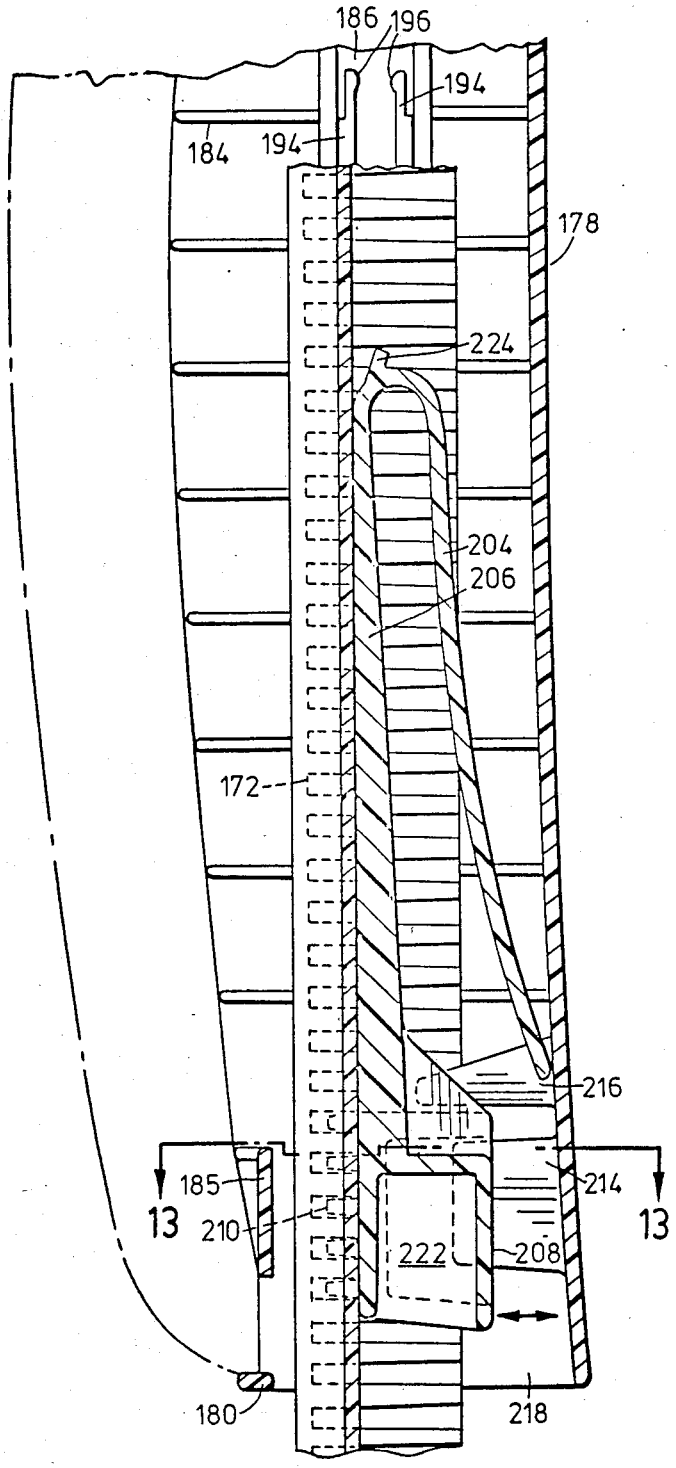
FIG. 12 is a sectional view taken on lines 12—12 of FIG. 11 but with the backrest and locking lever installed.
Figure 14:
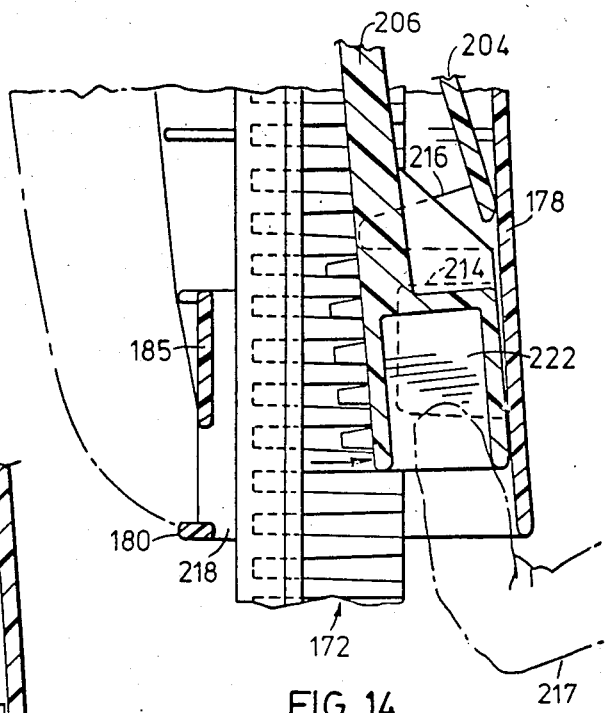
FIG. 14 is a sectional view showing a portion of the backrest column and showing the backrest locking lever in its shift position.

The seat section 14 and its connection to the arms 16 and to the base section 12 will first be described, with reference to FIGS. 2 through 11 inclusive. As shown in FIGS. 2 and 11, the seat section 14 includes a seat shell 22 formed of molded plastic with an upwardly extending encircling rim 23. The seat shell 22 has integral mushroom-shaped stdus 24 (FIG. 11) projecting from its upper surface for connection to an upholstered seat cushion (as will be described). The seat shell 22 includes a number of downwardly projecting thin ribs 26 integrally formed on its lower surface. Each rib 26 curves in an aesthetically pleasing design downwardly and inwardly from a position near the perimeter of the seat shell 22 to a position adjacent a central cylindrical downwardly extending seat column 28, and then extends laterally to meet an adjoining rib. Two of the ribs 26 have thickened extensions 30 (FIG. 2) for connection to the seat column 28.

The seat column 28 is formed of molded plastic and comprises a cylindrical lower portion 32, an upper box-like section 34, and integral connecting ribs 36. The two thickened rib extensions 30 of the seat shell are pivotally connected to the rear of the seat column box-like section 34 by pivot pins 38 (FIGS. 2, 3, 5) retained by cotter pins 40. This allows the seat shell 22 to pivot about a horizontal axis relative to the seat column 28, so that the seat can tilt from front to rear as indicated by arrows 41.

The front of the seat shell 22 is supported on the seat column 28 by a vertically oriented gas cylinder 42. The gas cylinder 42 is a standard purchased part and is biased to an extended position but can be telescoped (i.e. compressed) when its operating pin 44 is depressed, and is locked against telescoping when its pin 44 is not depressed. The lower end of the gas cylinder 42 is located in a housing 46 at the front of the seat column 28 and includes a projection 48 (FIG. 5) at its lower end having an opening 50 therein. The housing 46 includes two corresponding openings 52, 54, so that by insertion of a pin 56 through either of such openings and through the opening 50 in the projection 48 at the lower end of the gas cylinder, the bottom of the gas cylinder 42 can be located in either of two vertical positions, to adjust the range of front to rear tilting of the seat shell 22.

The gas cylinder 42 includes a conventional upwardly extending piston rod 58 on which is located a hollow male threaded nut 60. The nut 60 screws into a rotatable molded plastic bushing 62 (FIGS. 5, 6 and 7) located in a cylindrical seat 64. The seat 64 is located adjacent the front of the seat column 28 and is integrally molded with the seat shell 22. The opening pin 44 of the gas cylinder 42 thus projects into bushing 62.

Figure 5:
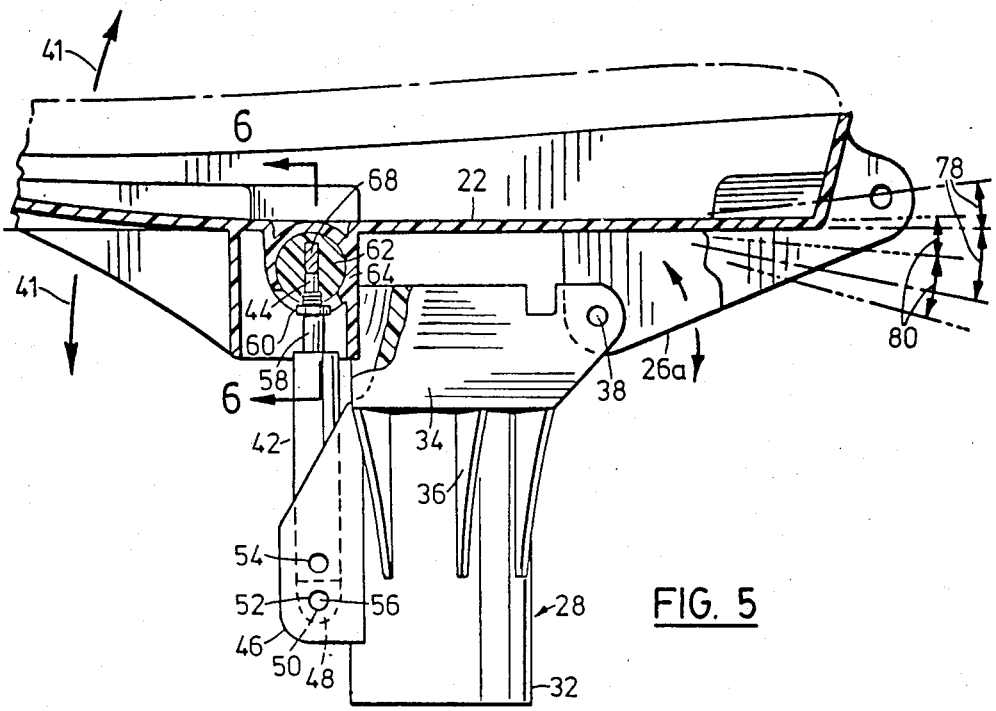
FIG. 5 is a view, partly in section, taken along lines 5—5 of FIG. 2.
Figure 6:
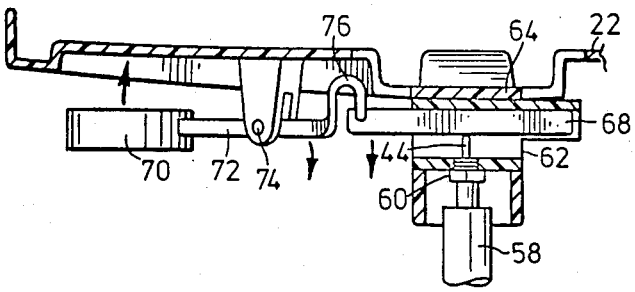
FIG. 6 is a view, partly in section, taken along lines 6—6 of FIG. 5.
Figure 7:
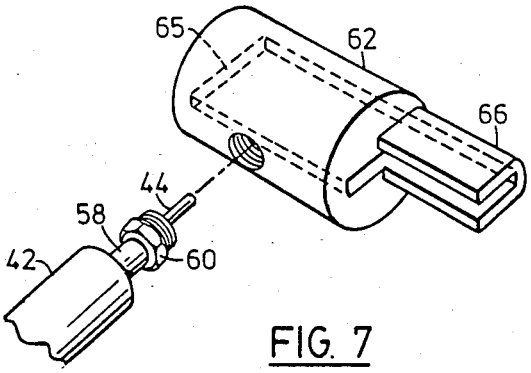
FIG. 7 is a perspective exploded view showing a rotatable bushing of FIG. 6.
Figure 8:
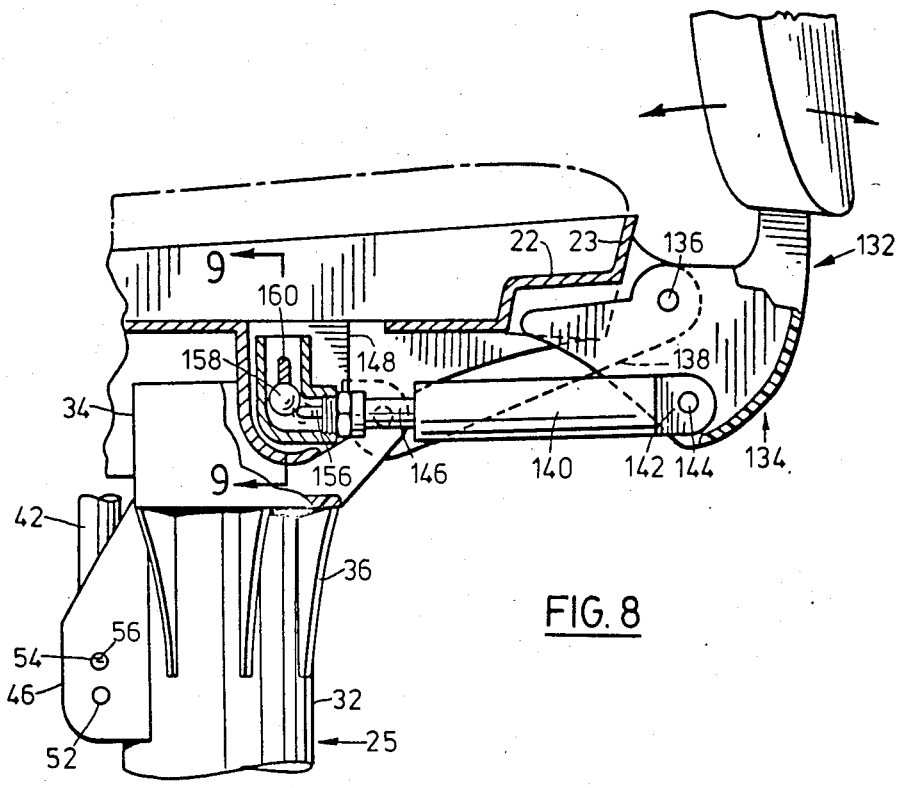
FIG. 8 is a view, partly in section, taken along lines 8—8 of FIG. 2.

As best shown in FIG. 7, the rotatable bushing 62 includes a central internal slot 65 extending therethrough and a sideways protruding integrally molded end channel 66 which effectively extends the slot 65. A floating control rod 68 (FIGS. 5, 6) extends through the slot 65 and channel 66 and is operated by a disc-like plastic control button 70. The control button 70 includes a metal operating rod 72 molded therein. The rod 72 is pivoted at pin 74 beneath the seat shell 22 and has an upwardly extending U-shaped end 76 which is inserted into the end of the control rod 68. Thus, when the button 70 is pushed upwardly as indicated by the arrow in FIG. 6, the floating control rod 68 will be pushed downwardly to depress the operating pin 44 of gas cylinder 42, thereby permitting the entire seat shell 22 (and the backrest section 18 attached thereto) to tilt forwardly and rearwardly about seat column 28 as indicated by arrows 41. With the pin 56 in the lower hole 52 as shown in FIG. 5, the range of tilting is indicated by arrows 78. With the pin 56 in upper hole 54, the range of tilting is indicated by arrows 80.

Figure 3:
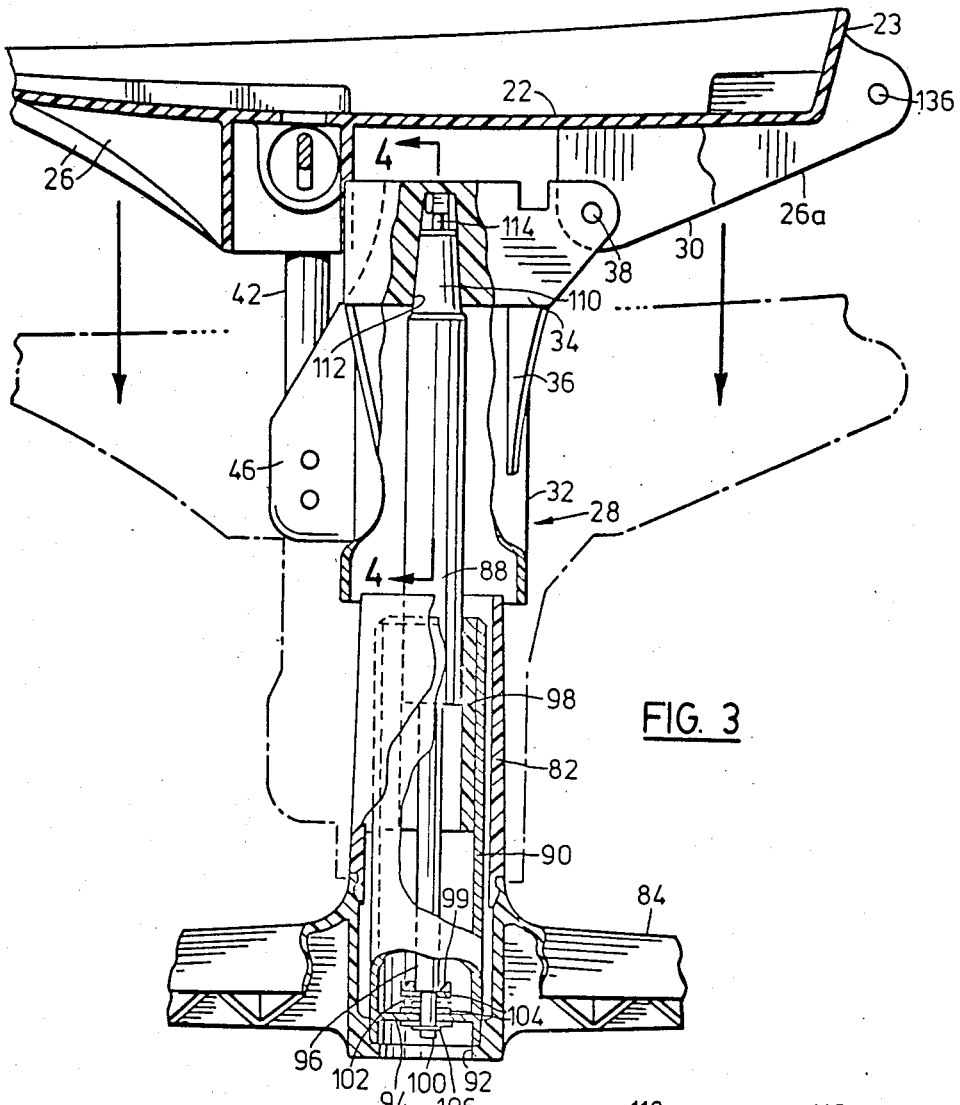
FIG. 3 is a view, partly in section, taken along lines 3—3 of FIG. 2 and further showing a portion of the chair base.
Figure 4:
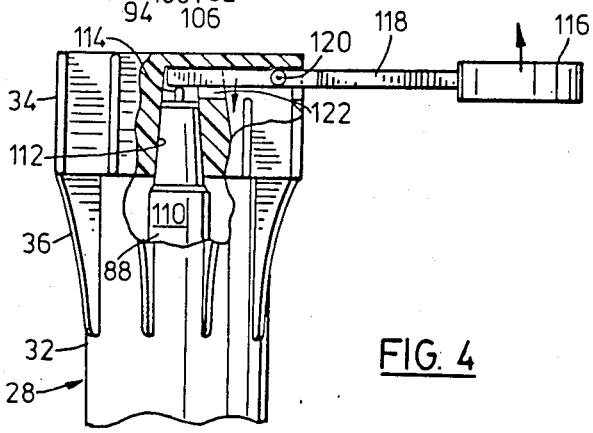
FIG. 4 is a view, partly in section, taken along lines 4—4 of FIG. 3.
Figure 18:
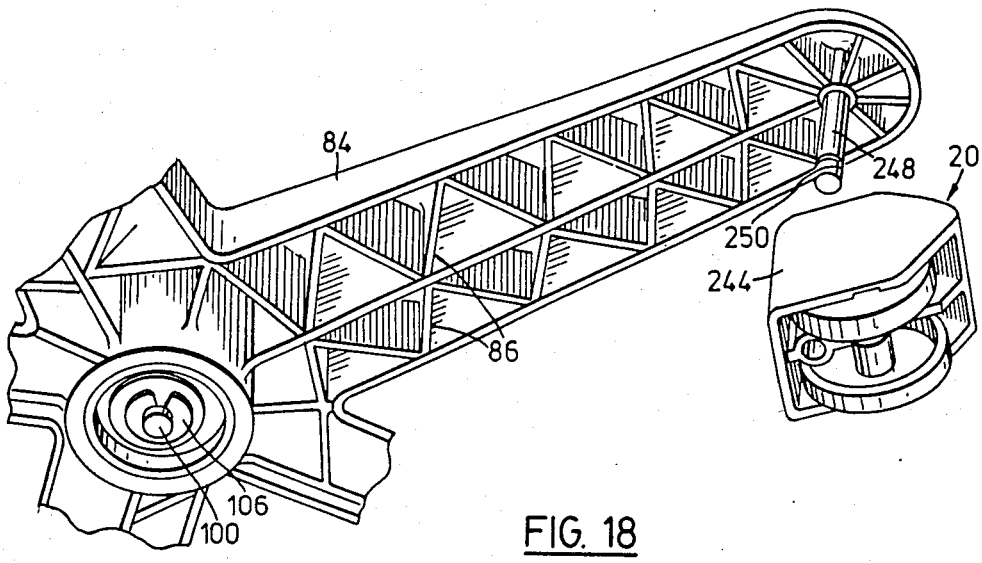
FIG. 18 is a perspective exploded view showing the underside of a portion of the base of the FIG. 1 chair with a castor ready to be snapped into position.
Figure 19:
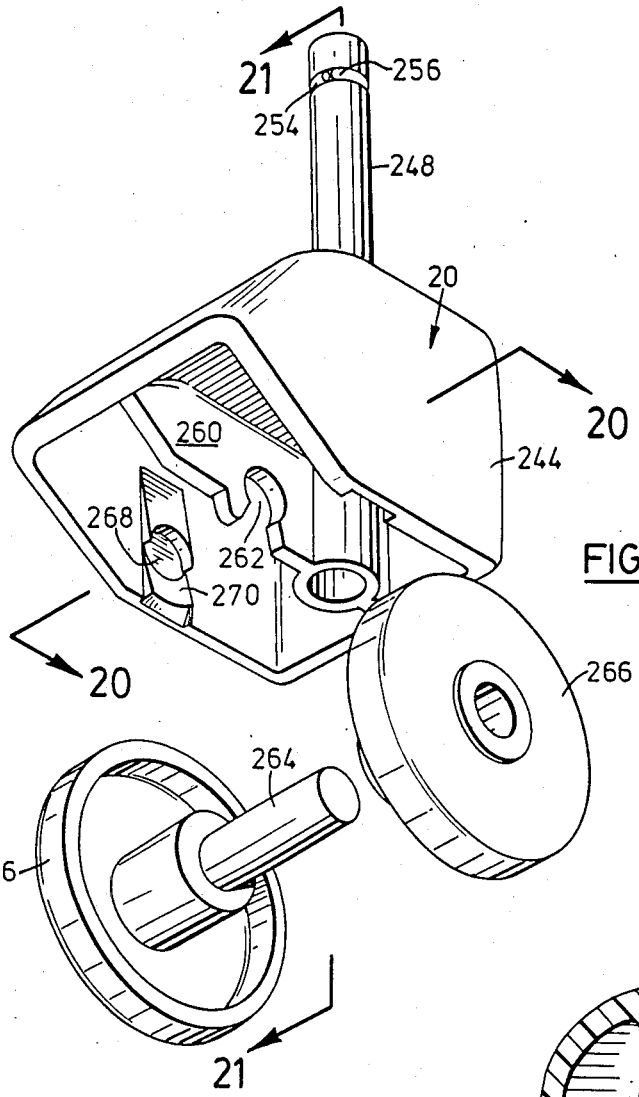
FIG. 19 is a perspective exploded view of the castor of FIG. 18.
Figure 20:
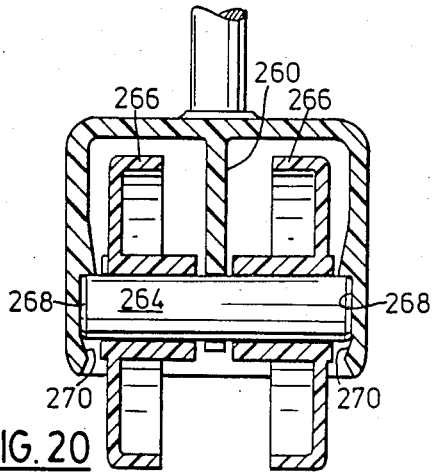
FIG. 20 is a sectional view taken along lines 20—20 of FIG. 19.
Figure 21:
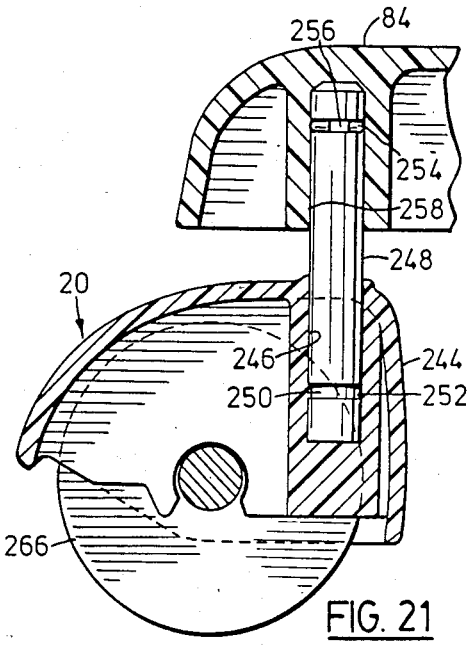
FIG. 21 is a sectional view taken along lines 21—21 of FIG. 19.

The seat column 28 is supported on the base section 12 as follows. As shown in FIG. 3, the base section 12 includes a central vertical cylindrical base column 82 having at its lower end a number of outwardly extending legs 84, all integrally molded of plastic. Each leg 84 includes an integral criss-cross web 86 (FIG. 18) of plastic material for reinforcing purposes.

A second conventional gas cylinder 88 extends into the base column 82 and into the seat column 28 and supports the seat column on the base column. For this purpose the base column 82 has therein a cylindrical support sleeve 90 which rests on a lip 92 at the bottom of base column 82 and contains a cross web 94 to support the piston rod 96 of the gas cylinder 88. A thickened plastic guide sleeve 98 rests within support sleeve 90 at its top and constrains the bottom of the gas cylinder 88. The piston rod 96 extends downwardly through the sleeve 90 and through a rubber bumper 99. At the tip of the piston rod a shaft 100 extends downwardly through a thrust bearing 102 and washers 104, through the web 94 and is retained by a retainer clip 106. The entire cylinder 88, including piston rod 96 and shaft 100, are rotatable within sleeve 98 and web 94, to allow rotation of the seat section relative to the base section.

The lower cylindrical portion 32 of the column 28 encircles the upper part of the base column 82 to cover the arrangement described.

The upper part of the gas cylinder 88 is tapered as indicated at 110 and has a friction fit into a downwardly facing tapered hole 112 (FIG. 3) in the box-like section 34 of the seat column. The friction fit is quite secure, but for disassembly the seat section can simply be pulled off the tapered end 110 of the gas cylinder 88 by a hard pull.

The gas cylinder 88 is biased toward an extended position but is able to move only when its control pin 114 is depressed. Control is provided by a disc-like control button 116 (FIGS. 2, 4) located between two of the ribs 26, beneath the seat shell 22. The control button 116 is connected to a lever 118 pivoted by a pin 120 extending through the seat shell 122. The lever 18 extends through a slot 122 (FIG. 4) in the box-like section 34 and into the tapered hole 112 above pin 114. As shown, when the control button 116 is moved upwardly, the control pin 114 will be depressed to allow the seat section 14 together with the backrest section 18 to be raised with the aid of the pressure in the gas cylinder 88, or to be lowered against the pressure in the gas cylinder 88.

The arms 16, shown in FIGS. 1 and 2, each comprise a vertical armrest section 124 and a horizontal tapered inwardly extending mounting section 126. Each mounting section 126 fits between pairs of ribs 26 and has three slots 128 therein to accommodate bolts 130 which fasten in the seat shell 22. Thus the arms 16 can be omitted from the chair or can be assembled in a range of inboard or outboard positions depending on the position in which the bolts 130 are inserted through the slots 128. The arms 16 are also preferably of molded plastic.

The backrest section 18 includes a central vertical backrest column 132 (FIG. 11) having a lower forwardly extending bottom part 134. The sides of the bottom part 134 are pivotally connected by pins 136 to rearward extensions 138 (FIGS. 2, 8 and 11) of the same ribs **26*a* as those to which the thickened extensions 30 are connected. (The pins 136 are held in place by cotter pins, not shown, for easy removal.) This allows the backrest column 132 to tilt frontwardly and rearwardly about the seat shell 22. Such tilting is controlled by a conventional back tilt gas cylinder 140, shown in FIGS. 2 and 8 to 10** inclusive.

Figure 9:
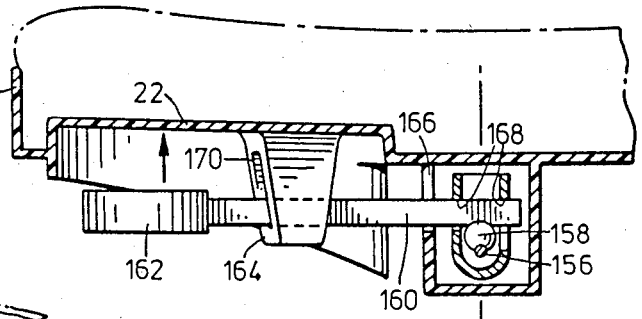
FIG. 9 is a view, partly in section, taken along lines 9—9 of FIG. 8.
Figure 10:
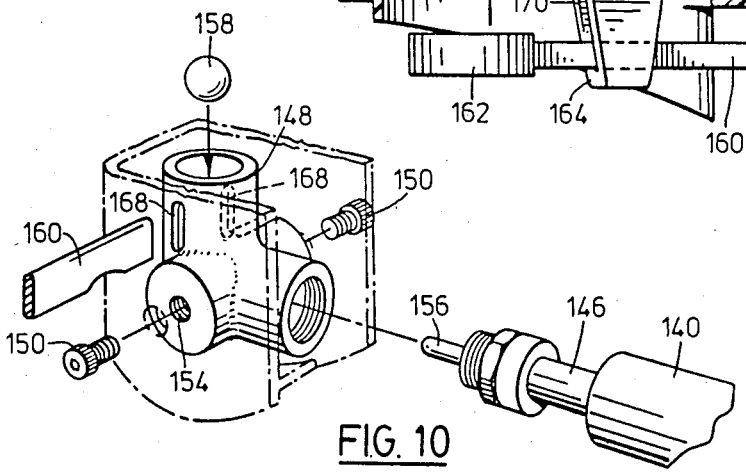
FIG. 10 is a perspective exploded view showing details of the backrest tilt cylinder and its connections.

The rear end of the gas cylinder 140 includes a projection 142 therefrom which is pivotally connected by a transverse pin 144 (FIG. 2) to the bottom part 134 of backrest column 132. The piston rod 146 of gas cylinder 140 extends forwardly into an L-shaped tubular fitting 148 which is secured by bolts 150 within a U-shaped molded portion 152 (FIG. 10) integral with and extending below the seat shell 22. (Molded portion 152 fits within the box-like section 34 of the seat column 28.) The bolts 150 extends into threaded holes 154 in the fitting 148. An operating pin 156 on the piston rod 146 extends into the fitting 152, to a position beneath a ball 158. The ball 158 can be forced downwardly by a horiziontally oriented control rod 160. The control rod 160 extends from a disc-like control button 162, through a downwardly extending projection 164 of the seat shell 22, through a slot 166 in the U-shaped molded part 152, and through slots 168 in the fitting 148. When the control button 162 is moved upwardly as shown in FIG. 9, the upper inner end of rod 160 bears against the upper edges of slots 168 in the fitting 148, thus depressing the ball 158, camming the operating pin 156 horizontally and unlocking the gas cylinder 140. This causes the backrest section 18 to become free floating (although it is biased forwardly by gas cylinder 140). If desired the control button 162 can be left retained in a raised position in a locking notch 170 (FIG. 9) in the projection 164, so that the backrest section will at all times be free floating. Alternatively, after the backrest section is adjusted to a desired tilt, the control rod 160 can be left in the position shown in FIG. 9 (and FIG. 2), in which event the backrest section will remain in the position in which it has been set.

Reference is next made to FIGS. 11 through 17 inclusive, which show the manner in which the backrest section 18 is assembled. As shown, the backrest column 132 includes a number of rearwardly facing L-shaped teeth 172, forming a vertically oriented rack. The backrest column 132 also includes a rearwardly projecting stop 174 at its top.

The backrest section 18 further includes a backrest shell 176 adapted to be inserted onto the backrest column 132 and to be retained in any one of a number of positions. The backrest shell 176 is formed of molded plastic in any desired configuration, and includes a plastic rear sheet 178, an encircling rim 180, and a pair of vertically extending laterally spaced main ribs 182. Each main rib 182 is reinforced by horizontally extending secondary ribs 184 integrally molded with the plastic rear sheet 178. At their bottoms the ribs 182 are joined by a cross brace 185.

Each main rib 182 includes (see particularly FIGS. 11, 13 and 16) an inwardly facing channel 186 having openings 188 (FIG. 16) spaced therealong. Each channel 188 is arranged to receive a column guide insert 190, best shown in FIG. 16. Each guide insert 190 is molded of a slippery plastic material and is formed by a number of spaced opposed side sections 192 joined by staggered vertically spaced bottom sections 194. The bottom sections 194 and side sections 192 are each equipped with inwardly protruding rounded protrusions or glides 196 to reduce the friction as the backrest column slides therein. Each guide insert 190 includes at its rear a set of snap latch retainers 198 FIG. 17) which are inserted through the openings 188 in the channels 186. The retainers 198 expand once they have been passed through openings 188, to hold the guide inserts 190 in position in the channels 186.

The backrest column 132 includes at its sides outwardly projecting, vertically extending flanges 200 which fit snugly within the guide inserts 190, so that the backrest shell 176 may slide smoothly up and down the backrest column 132.

The backrest shell 176 is retained in a desired position on the backrest column 132 by a generally U-shaped resilient plastic locking lever 202 (FIG. 11). The locking lever 202 includes a rear leg 204, and a front leg 206. The front leg 206 carries a lower generally box-shaped portion 208 having forwardly projecting teeth 210 at each side thereof which mate with the teeth 172 on the backrest column 132. At its rear the box-shaped portion 208 includes a pair of slots 212 which (when the backrest section is assembled) are located on a pair of forwardly projecting studs 214 on the rear plastic sheet 178. A pair of stops 216 located above the studs 214 assist in preventing the locking lever 202 from moving upwardly when assembled.

Figure 13:
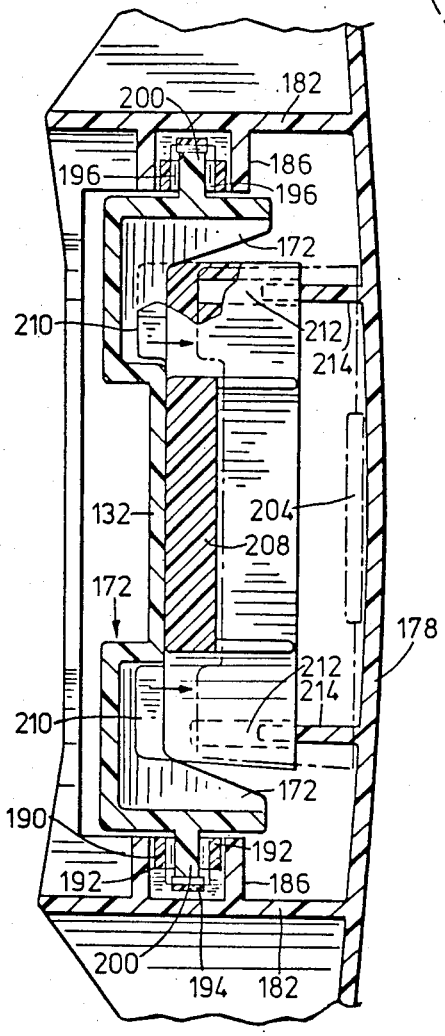
FIG. 13 is a sectional view taken along lines 13—13 of FIG. 12.

As best shown in FIGS. 11 and 13, the rim 180 of the backrest shell has an opening 218 therein at its bottom, between main ribs 182, through which locking lever 202 may be inserted for assembly.

To assemble the backrest shell 176 to the backrest column 132, the locking lever 202 is first inserted through the opening 218 at the bottom of the backrest shell, into the space between the main ribs 182. This is accomplished simply by compressing the legs of locking lever 202 together to the dotted line position shown in FIG. 11 and then inserting the locking lever 202 through the opening 218 until the slots 212 are located over and receive the studs 214. Next, with the locking lever 202 still held compressed, the backrest column 132 is inserted upwardly through the opening 218, with the flanges 200 located in the guide inserts 190. When the locking lever 202 is now released, its teeth 210 will engage with the teeth 172 of the backrest column 132 to hold the backrest shell 176 in any desired vertical position. To adjust the position, the user simply inserts a finger 217 (FIG. 14) through the opening 218 to compress the locking lever 202 legs together, disengaging the teeth 210 from the teeth 172 and allowing the backrest shell 176 to be slid up and down. The bottom of the box-shaped portion 208 is open as indicated at 222, to accommodate a user's finger.

When the backrest shell 176 is slid down sufficiently, a stop 220 (which also acts as a cross-brace) near the top of the backrest shell 176 engages the top of the backrest column 132, preventing further downward movement. When the backrest shell 176 is slid upwardly, a protrusion 224 at the top of the locking lever 202 engages the stop 174 at the top of the backrest column 132, preventing further upward movement.

Figure 15:
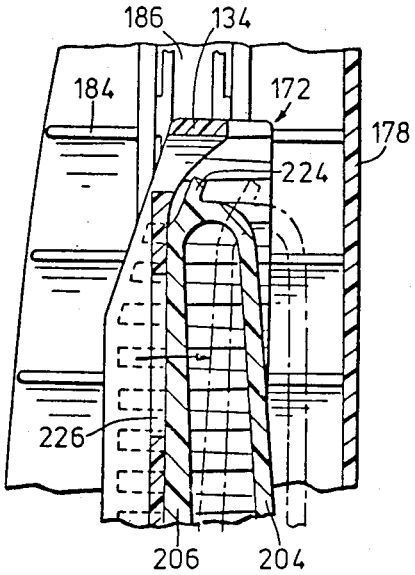
FIG. 15 is a view similar to FIG. 14 but taken further up the backrest column and with the backrest locking lever in its locking position.
Figure 16:
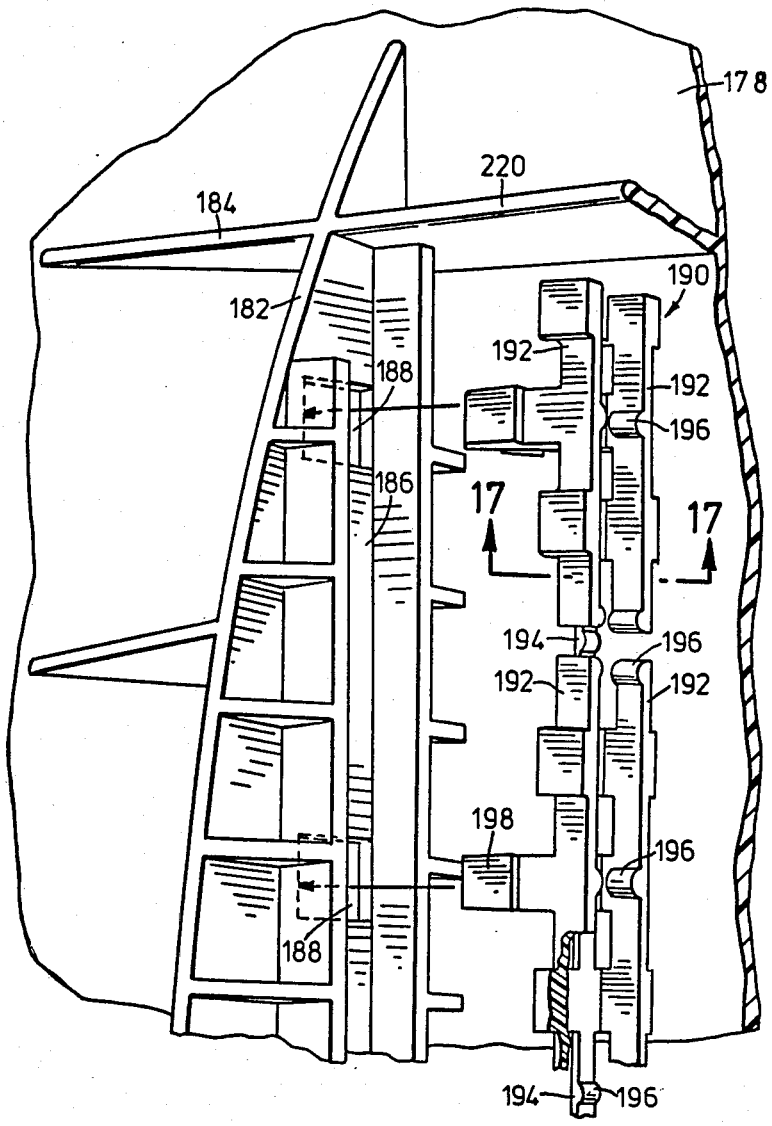
FIG. 16 is a perspective view of a portion of the backrest.
Figure 17:
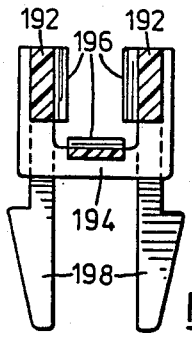
FIG. 17 is a sectional view taken along lines 17—17 of FIG. 16.

To disassemble the backrest shell from the backrest column, the user simply inserts his hand through an access opening 226 (FIGS. 11, 15) in the backrest column 132, and pushes the top of the locking lever 202 rearwardly so that the protrusion 224 is located rearwardly of the stop 174, as shown in the dotted line position of FIG. 15. The backrest shell 176 can then be slid upwardly and disengaged from the backrest column 132.

Figure 22:
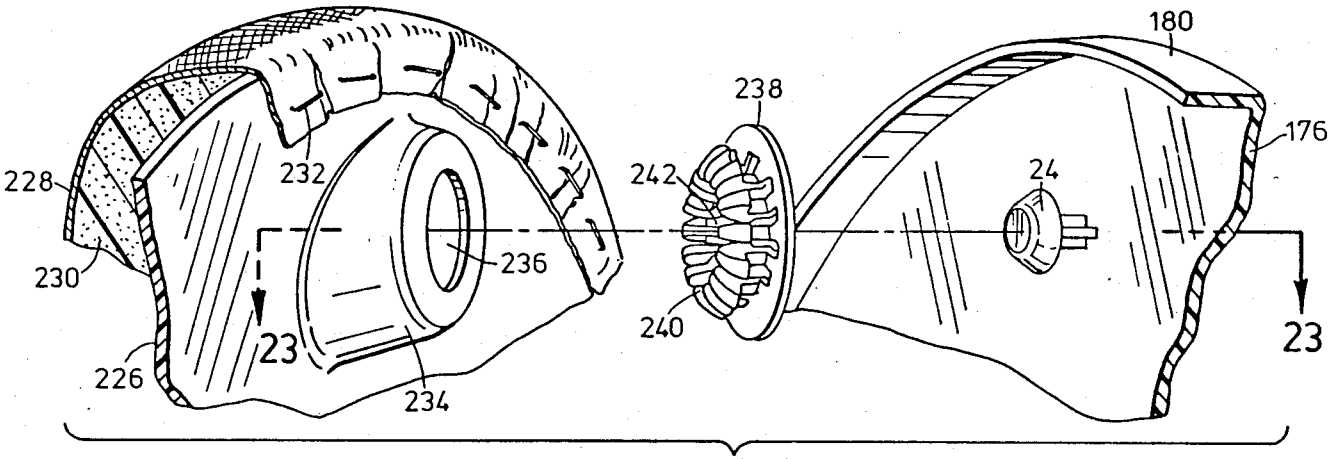
FIG. 22 is an exploded view showing the manner in which the backrest of the chair is assembled.
Figure 24:
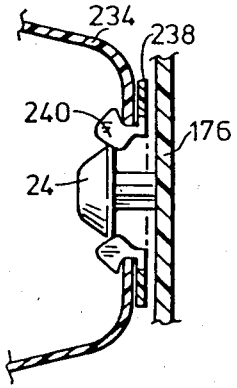
FIG. 24 is a sectional view showing the FIG. 23 arrangement assembled together.
Figure 23:
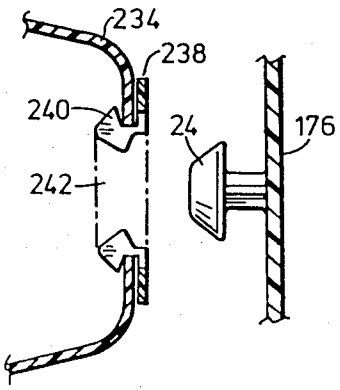
FIG. 23 is a sectional view along lines 23—23 of FIG. 22.

The backrest and seat shells 176, 22 are both upholstered as follows. As shown in FIG. 22, a plastic backing sheet 226 is provided, of configuration suitable either for the backrest shell or for the seat shell, as desired. The backing sheet 226 may be upholstered with fabric 228 and a foam cushion 230 stapled thereto with staples 232 as shown in FIG. 22. Each backing sheet 226 includes a number of protrusions 234, each protrusion 234 having a round hole 236 in its end surface. Gripper elements 238 are provided, each in the form of an annular plastic disc having upwardly and outwardly extending teeth 240 of flexible plastic. The teeth 240 are generally T-shaped and are arranged in a circular configuration with a central opening 242. The teeth 240 can be snapped into the holes 236 in the protrusions 234. The mushroom-shaped studs 24 from the backrest shell 176 or seat shell 22 can then be snapped into the openings 242 between the teeth 240, as shown in FIGS. 23 and 24. This arrangement holds the upholstered sheet 226 securely in position, but if desired, it can readily be pried off for removal and replacement of the upholstery.

Reference is next made to FIGS. 18 to 21, which show the details of the castors 20 for the chair. As shown, each castor 20 includes a flexible plastic housing 224 having an upwardly opening bore 246 to receive a vertical metal pin 248. The pin 248 includes a circumferential groove 250 at its lower end which receives a small plastic ridge 252 in the bore 246 to hold the pin 248 in the castor housing 244. The upper end of the pin 248 includes a retaining spring clip 254 located in a groove 256 in the pin. This holds the pin 248 in a corresponding bore 258 in the lower surface of the end of the leg 84.

The castor housing 244 further includes a central wall 260 of flexible plastic containing a generally C-shaped opening 262 of flexible plastic, into which an axle 264 can be snapped. A pair of plastic wheels 266 are free floating on the axle 264, the ends of the axle protruding past the wheels into outer C-shaped recesses 268 in the outer walls of the castor housing 244. The lower ends of the C-shaped recesses 268 slope inwardly, forming ramps 270. Thus, when the axle 264 is inserted into the housing 244, it rides up the ramps 270, snaps into position in the recesses 268 and C-shaped opening 262, and thereby is retained in position. If a castor requires repair, it can be either totally removed from the leg 84 simply by being pulled therefrom, for replacement, or alternatively the wheels can be removed from the housing 244 by distorting the housing walls outwardly and removing the axle 264.

In summary, because the chair 10 is formed almost entirely of plastic, it is relatively lightweight as compared with a metal chair, and because the plastic preferably is molded in a solid colour, scratches will not be of a different colour. The chair illustrated and described can be disassembled with a minimum of tools, since the various pins are held in position by cotter springs and since there are relatively few bolts or screws required.

Although gas cylinders have been shown, ordinary mechanical spring biasing means can also be used if desired.

I claim:

1. A chair formed primarily of plastic material and comprising:

(a) a base, comprising a vertical central base column and legs radiating outwardly therefrom, said base column and legs all being integrally formed of plastic, (b) a seat section comprising a plastic seat shell, having upper and lower surfaces, a plastic central seat column extending downwardly below said seat shell, and a plurality of reinforcing plastic ribs integrally formed on the lower surface of said seat shell, (c) means connecting said seat shell to said seat column, (d) means connecting said seat column to said base column for rotation of said seat section about a vertical axis relative to said base, (e) a backrest column formed of plastic and including a plurality of vertically spaced teeth, (f) means connecting said backrest column to said seat shell, (g) a backrest shell of plastic removably connected to said backrest column and having a front surface, said backrest shell being slidable vertically on said backrest column and including a substantially U-shaped plastic locking lever which is removably inserted into said shell and has a plurality of teeth thereon to engage said teeth of the backrest column and to lock said backrest shell onto said backrest column in any one of a plurality of vertical positions, said lever being flexible to permit disengagement of said teeth when the vertical position of the backrest shall is to be changed, said backrest shell further including a pair of vertically extending laterally spaced ribs, one on each side of said backrest column, said locking lever being located between said ribs and having a box-like structure at its lower end, said box-like structure having said teeth at its front surface and having a pair of slots at its rear surface, and a pair of studs located on said backrest shell between said ribs and projecting into said slots to locate and secure said locking lever, (h) upholstered back cushion means, and means for removably connecting said back cushion means to said front surface of said backrest shell, and (i) upholstered seat cushion means, and means for removably connecting said seat cushion means to said upper surface of seat shell.

2. A chair according to claim 1 wherein said means (d) connecting said seat column to said base column comprises a gas cylinder to allow raising and lowering of said seat section relative to said base, said gas cylinder projecting upwardly into said seat column and downwardly into said base column.

3. A chair according to claim 2 wherein said means (f) connecting said backrest column to said seat shell comprises pivot means pivotally connecting said backrest column to said seat shell for rotation of said backrest column about a horizontal axis relative to said seat shell, and a horizontally oriented gas cylinder pivotally connected between said backrest column and a position on said seat section adjacent said seat column for permitting front to rear tilting of said backrest column and backrest shell.

4. A chair according to claim 3 wherein said horizontally oriented gas cylinder is connected to said seat shell.

5. A chair according to claim 1, 2 or 3 wherein said means (c) connecting said seat shell to said seat column includes means pivotally connecting said seat shell to said seat column adjacent the rear of said seat column for rotation of said seat shell about a horizontal axis relative to said seat column, and a vertically oriented gas cylinder adjacent the front of said seat column and connected between said seat shell and said seat column to allow front to rear tilting of said seat shell.

6. A chair according to claim 1, 2 or 3 and including a pair of arms, each arm having an upper armrest and a lower inwardly extending support, and means removably securing said lower inwardly projecting support to said lower surface of said seat shell.

7. A seat according to claim 1 or 3 and including a plurality of plastic castors, one for each leg, each castor having a plastic housing, a horizontal axle having wheel means mounted thereon, said housing having flexible sidewalls, said sidewalls including detent means therein for removably securing said axle so that when said sidewalls are bent outwardly, said axle with said wheel means may be removed therefrom.

8. A chair according to claim 1, wherein said means (d) connecting said seat column to said base column comprises means to allow raising and lowering of said seat section relative to said base, and wherein said means (f) connecting said backrest column to said seat shell comprises pivot means pivotally connecting said backrest column to said seat shell for rotation of said backrest column about a horizontal axis relative to said seat shell, and means pivotally connected between said backrest column and a position on said seat section adjacent said seat column for permitting front to rear tilting of said backrest column and backrest shell.

9. A chair according to claim 8 wherein said means (c) connecting said seat shell to said seat column includes means pivotally connecting said seat shell to said seat column adjacent the rear of said seat column for rotation of said seat shell about a horizontal axis relative to said seat column, and means adjacent the front of said seat column and connected between said seat shell and said seat column to allow front to rear tilting of said seat shell.

* * * * *